US009970216B1

(12) United States Patent
Skolness

(10) Patent No.: US 9,970,216 B1
(45) Date of Patent: May 15, 2018

(54) SECURITY DOOR FEATURES

(71) Applicant: James Skolness, Parker, CO (US)

(72) Inventor: James Skolness, Parker, CO (US)

( * ) Notice: Subject to any disclaimer, the term of this patent is extended or adjusted under 35 U.S.C. 154(b) by 360 days.

(21) Appl. No.: 14/594,841

(22) Filed: Jan. 12, 2015

Related U.S. Application Data

(60) Provisional application No. 62/090,214, filed on Dec. 10, 2014.

(51) Int. Cl.

| | |
|---|---|
| ***E05C 1/04*** | (2006.01) |
| ***E05B 63/00*** | (2006.01) |
| ***E05B 63/24*** | (2006.01) |
| ***E05B 13/04*** | (2006.01) |

(52) U.S. Cl.
CPC ..... *E05B 63/0052* (2013.01); *E05B 13/04* (2013.01); *E05B 63/0034* (2013.01); *E05B 63/24* (2013.01)

(58) Field of Classification Search
CPC ..... E05B 15/0205; E05B 17/0045; E05B 63/0052; Y10T 70/7927; Y10S 292/56
See application file for complete search history.

(56) References Cited

U.S. PATENT DOCUMENTS 1,018,887 A * 2/1912 Dumbier ..... E05B 65/0864 292/57
1,315,266 A * 9/1919 Weiland ..... E05B 65/0864 292/60
1,675,033 A * 6/1928 Lefkovitz ..... E05C 1/04 292/60
2,379,030 A * 6/1945 Neitzel ..... A63F 3/06 101/102
3,606,422 A * 9/1971 Hennessy ..... E05B 63/0017 292/139
3,626,507 A * 12/1971 Hawkins ..... E05B 65/0864 292/175
4,869,087 A * 9/1989 Day ..... E05B 17/2084 292/346
5,746,455 A * 5/1998 Takimoto ..... E05C 1/04 292/145
5,934,024 A * 8/1999 Simpson ..... E05B 15/0205 49/394

(Continued)

OTHER PUBLICATIONS

Sargent and Greenleaf, "The Brute® Electronic Door Deadlatch".

(Continued)

*Primary Examiner* — Mark A Williams
(74) *Attorney, Agent, or Firm* — Brownstein Hyatt Farber Schreck, LLP

(57) ABSTRACT

A security door system includes a door jamb, a door, and a deadbolt mechanism. The door jamb includes a soffit and an aperture defined in the soffit. The deadbolt mechanism is mounted to a surface of the door and out of a plane of the door such that a deadbolt of the deadbolt mechanism is operable to project into the aperture in a locked position. In various implementations, the deadbolt mechanism may be mounted to the surface of the door by attachment members such as bolts that extend through attachment member apertures in the door. Shock absorbent material may be variously positioned around the attachment members in the attachment member apertures and may absorb at least some shock from a force applied to the deadbolt mechanism.

20 Claims, 5 Drawing Sheets

(56) References Cited

U.S. PATENT DOCUMENTS

| | | | | |
|---|---|---|---|---|
| 6,684,570 | B1 * | 2/2004 | Robledo | E05B 65/0035 292/145 |
| 6,938,376 | B2 * | 9/2005 | Youssef | B64C 1/1469 114/201 R |
| 7,172,222 | B1 * | 2/2007 | Hotovy | E05C 1/04 292/137 |
| 7,396,055 | B2 | 7/2008 | Arneson et al. | |
| 8,528,272 | B1 * | 9/2013 | Foss | E05F 17/001 52/106 |
| 2003/0159361 | A1 | 8/2003 | Yeremian | |
| 2008/0018117 | A1 | 1/2008 | Yeremian | |
| 2009/0077912 | A1 | 3/2009 | Yeremian | |
| 2010/0180511 | A1 * | 7/2010 | Mahdi | E05B 15/02 49/501 |
| 2011/0138718 | A1 | 6/2011 | Yeremian | |
| 2013/0229023 | A1 | 9/2013 | Yeremian | |
| 2014/0165886 | A1 | 6/2014 | Yeremian | |

OTHER PUBLICATIONS

Lockey USA, "Lockey Surface Mount Installation Instructions, M220 Deadbolt | C120 Deadbolt | C150 Hookbolt".

"Sliding patio door handles—Replacing surface mount handles," http://www.fixingscreens.com/sliding-pati-door-handles.html, downloaded Dec. 19, 2014.

Jet Fast Company Limited, "Rubber Nut-Insert," http://www.jetfast.com.tw/rubber_nut_insert.html, downloaded Dec. 19, 2014.

Security Door Controls, "SDC 180 / 280 Series Surface Mount Bolt Locks," 2012 Security Door Controls LIT-180/280SurfaceBoltLocks, Sep. 2012.

* cited by examiner

SECURITY DOOR FEATURES

CROSS-REFERENCE TO RELATED APPLICATION

This application claims the benefit under 35 U.S.C. § 119(e) of U.S. Provisional Patent Application No. 62/090,214, filed on Dec. 10, 2014, and entitled "Security Door Features," which is incorporated by reference as if fully disclosed herein.

TECHNICAL FIELD

This disclosure relates generally to security, and more specifically to features of a security door assembly.

BACKGROUND

Doors of various kinds are often moveably mounted (such as on hinges) in order to block off and/or allow access to an entrance of an enclosed space such as a home, office, business, and/or other building and/or room or other structure therein. In some cases, doors may be used to screen areas for aesthetic purposes. Doors may also be used to control the physical atmosphere within a space by enclosing air drafts, preventing the spread of fire, and/or acting as a barrier to noise.

In various cases, doors may include one or more security features, such as a lock, in order to prevent access by unauthorized persons (persons who have not been given the ability to). However, many security features may be overcome by unauthorized persons using sufficient force and/or other security feature defeating techniques. For example, an unauthorized person may defeat a lock by breaking down the door. By way of another example, an unauthorized person may defeat a lock by using a pry bar to break the door and/or a door jamb into which the door is mounted, popping free a mechanism of the lock that operates to secure the door in a locked position.

SUMMARY

The present disclosure discloses systems, apparatuses, and methods related to features of a security door. A security door system may include a door jamb including a soffit and an aperture defined in the soffit, a door, and a deadbolt mechanism mounted to a surface of the door and out of a plane of the door such that a deadbolt of the deadbolt mechanism is operable to project into the aperture in a locked position. In this way, the deadbolt mechanism may secure the door more effectively than a deadbolt mechanism mounted within the plane of the door and that projects a deadbolt into a rabbet of the door jamb.

In various implementations, the deadbolt mechanism may be mounted to the surface of the door by one or more attachment members that extend through a mounting plate positioned on an opposing surface of the door, through one or more attachment member apertures in the door, and into the deadbolt mechanism. Shock absorbent material may be variously positioned around the attachment members in the attachment member apertures and may absorb at least some shock from a force applied to the deadbolt mechanism. In some implementations, the attachment members may be positioned within a strengthening member. In one or more implementations, the security door system may also include a reinforcement plate that surrounds the aperture defined in the soffit and may extend over multiple surfaces of the soffit.

In various implementations, one or more tumbler bolts may extend through the door from the opposing surface of the door into a tumbler of the deadbolt mechanism. In some implementations, a manipulation mechanism may also extend from the opposing surface of the door through to the deadbolt mechanism and may be operable to transition the deadbolt mechanism between locked and unlocked positions.

In various embodiments, a security door system may include a door jamb with a soffit and an aperture defined in the soffit, a door, and a deadbolt mechanism mounted to a surface of the door and out of a plane of the door such that a deadbolt of the deadbolt mechanism is operable to project into the aperture in a locked position.

In some embodiments, a deadbolt assembly may include a deadbolt, a deadbolt mechanism coupled to the deadbolt operative to move the deadbolt between an unlocked and a locked position, and a mounting apparatus configured to mount the deadbolt mechanism to a surface of a door and out of a plane of the door such the deadbolt is operable to project into an aperture in a soffit of a door jamb in the locked position.

In one or more embodiments, a door jamb may include a soffit and an aperture defined in the soffit. The door jamb may be configured to accept projection of a deadbolt in a locked position from a deadbolt mechanism mounted to a surface of the door and out of a plane of the door.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure discloses systems, apparatuses, and methods related to features of a security door. A security door system may include a door jamb, a door, and a deadbolt mechanism. The door jamb may include a soffit and an aperture defined in the soffit. The deadbolt mechanism may be mounted to a surface of the door and out of a plane of the door (and thus in some implementations, external to the door) such that a deadbolt of the deadbolt mechanism is operable to project into the aperture in a locked position. In this way, the deadbolt mechanism may secure the door more effectively than a deadbolt mechanism mounted within the plane of the door and that projects a deadbolt into a rabbet of the door jamb (which may have a dimension smaller than that of the soffit).

In various implementations, the deadbolt mechanism may be mounted to the surface of the door by one or more attachment members (such as bolts) that extend through a mounting plate (such as a metal mounting plate) positioned on an opposing surface of the door, through one or more attachment member apertures in the door, and into the deadbolt mechanism. Shock absorbent material (such as polybutadiene, other polymer, and/or other shock absorbing material) may be variously positioned (partially, fully surrounding, and so on) around the attachment members in the attachment member apertures and may absorb at least some shock from a force applied to the deadbolt mechanism, such as in a direction perpendicular to the surface of the door.

In some implementations, the attachment members may be positioned within a strengthening member, such as a metal collar. In such implementations, shock absorbent material may be positioned between the attachment member and the strengthening member and/or may partially and/or fully surround the strengthening member in the attachment member aperture.

In one or more implementations, the security door system may also include a reinforcement plate that surrounds the aperture defined in the soffit. The reinforcement plate may extend over multiple surfaces of the soffit.

In various implementations, one or more tumbler bolts may extend through the door from the opposing surface of the door into a tumbler of the deadbolt mechanism. In some implementations, a manipulation mechanism may also extend from the opposing surface of the door through to the deadbolt mechanism. The manipulation mechanism may be operable to transition the deadbolt mechanism between locked and unlocked positions.

Figure 1A:
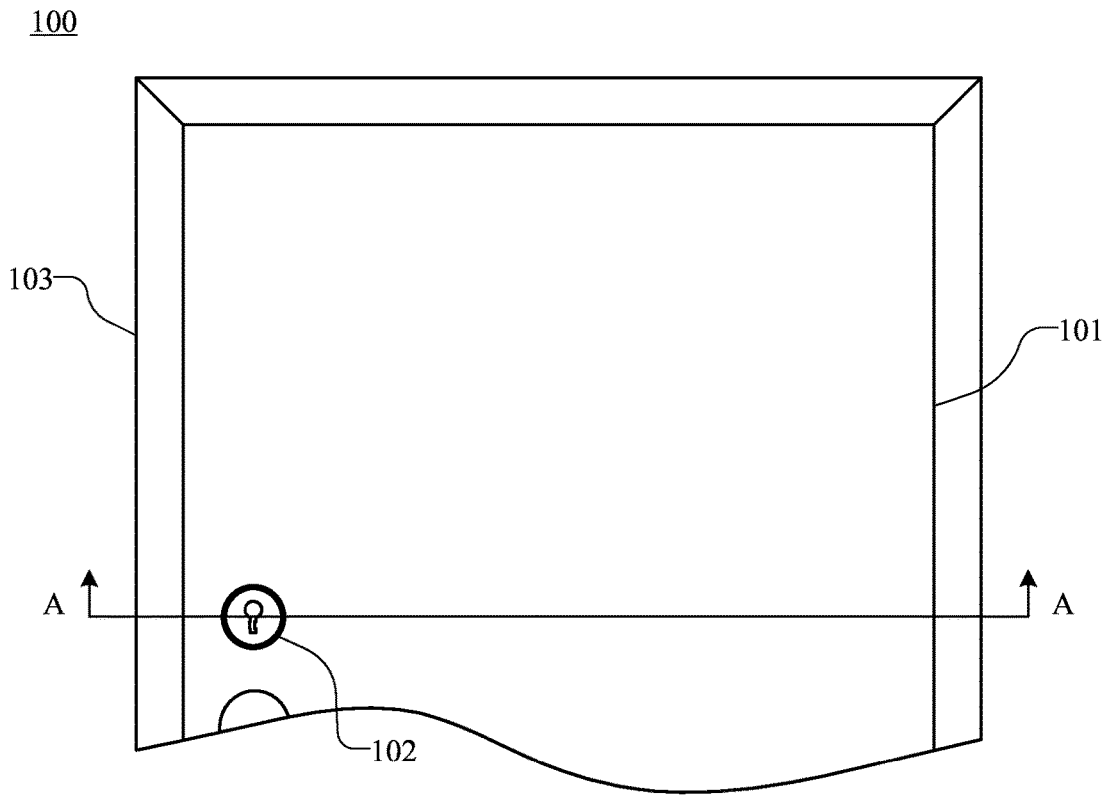
FIG. 1A is a front plan view of a first example security door system.

FIG. 1A is a front plan view of a first example security door system 100. As illustrated, the system may include a door 101 mounted within a door jamb 103 such that the door is moveable between open (not shown) and closed (shown) positions. As also illustrated, the system includes a first example deadbolt mechanism 102.

Figure 1B:
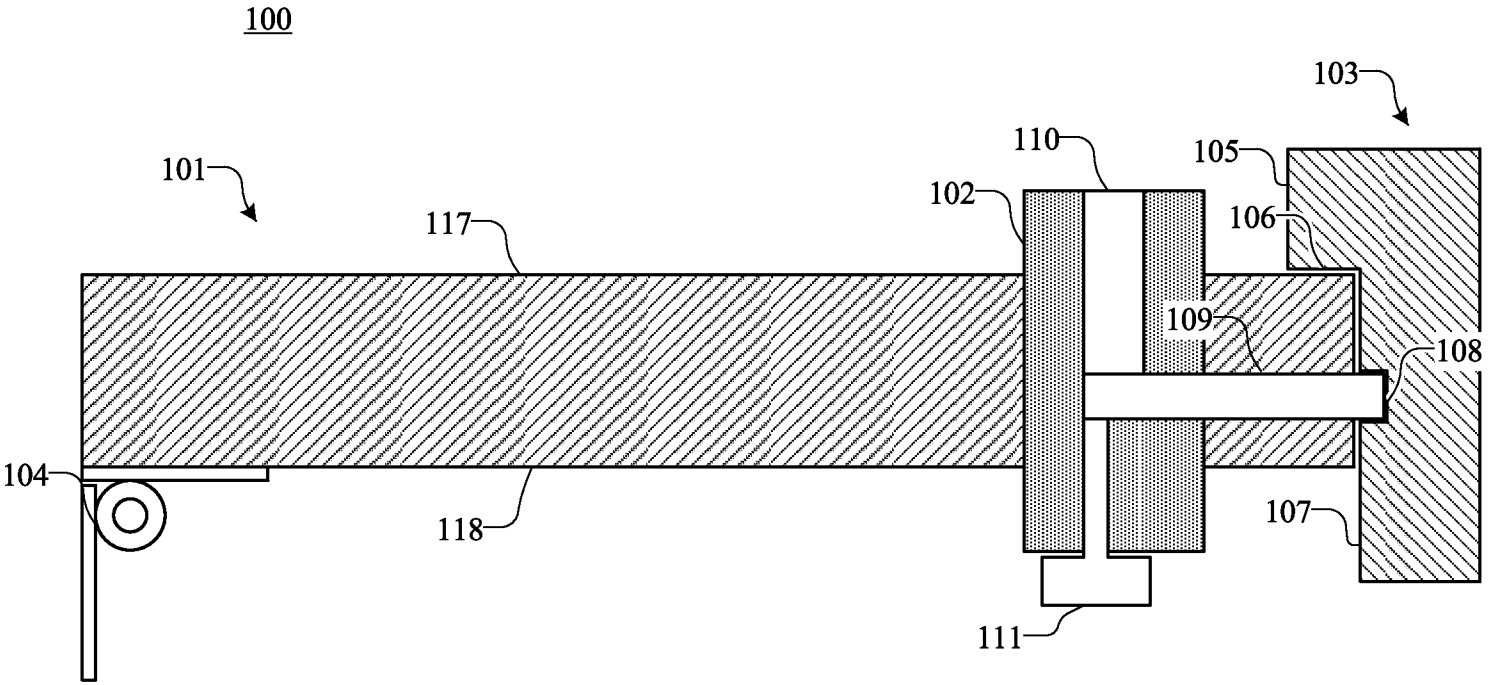
FIG. 1B is a cross sectional schematic view of the first example security door system of FIG. 1A, taken along line A-A of FIG. 1A.

FIG. 1B is a cross sectional schematic view of the first example security door system 100 of FIG. 1A, taken along line A-A of FIG. 1A. As illustrated, the door jamb 103 includes a rabbet 107 and a soffit 105. The rabbet portion of the door jamb has a smaller dimension than the soffit portion. The soffit portion includes a stop 106 that restricts outward motion of the door 101 on a hinge 104 beyond the closed position shown, where the door aligns with the rabbet. As also shown, the rabbet includes an aperture 108 into which the deadbolt 109 of the deadbolt mechanism 102 is operable to project in the locked position (shown).

As illustrated, the deadbolt mechanism 102 is positioned at least partially within the plane of the door 101 (at least partially internal to the door with portions projecting from both an outside surface 117 and an opposing, inside surface 118). The deadbolt mechanism includes a tumbler 110 and a manipulation mechanism 111 (shown as a knob) which are operable to transition the deadbolt mechanism between the shown locked position and an unlocked position (not shown) where the deadbolt is withdrawn from the aperture 108.

Figure 2A:
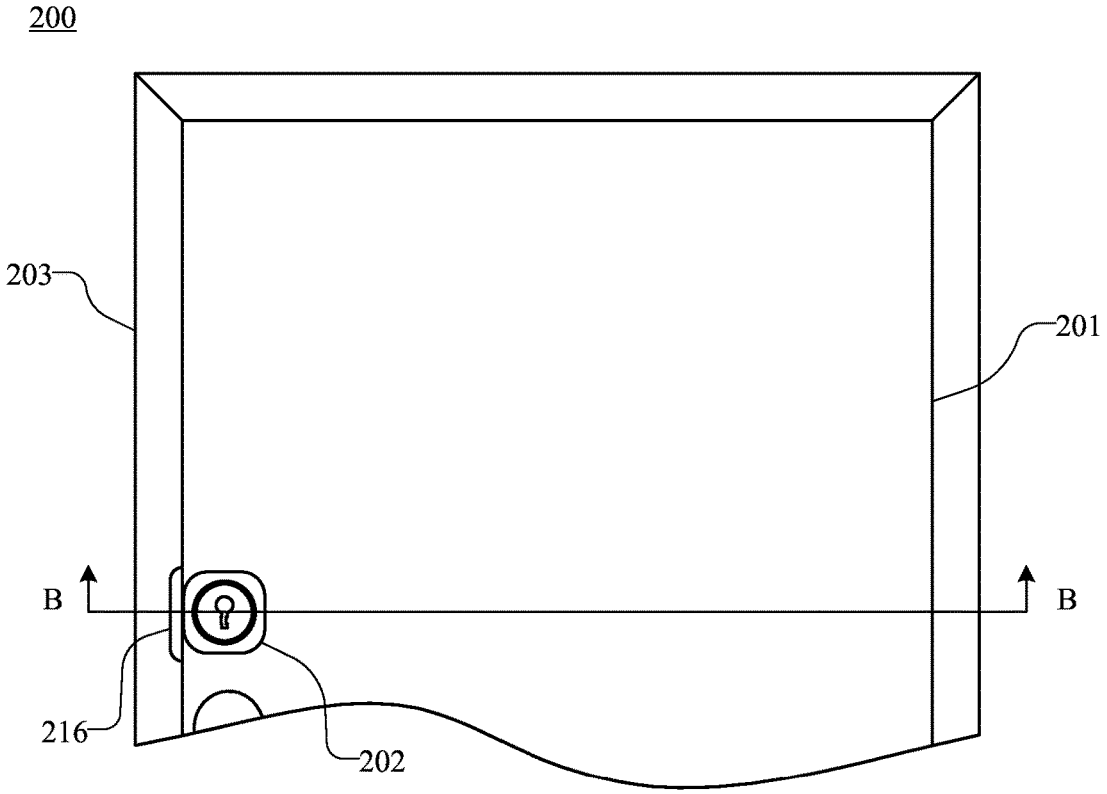
FIG. 2A is a front plan view of a second example security door system.

FIG. 2A is a front plan view of a second example security door system 200. As illustrated, the system may include a door 201 mounted within a door jamb 203 such that the door is moveable between open (not shown) and closed (shown) positions. As also illustrated, the system includes a second example deadbolt mechanism 202. The system may also include a reinforcement plate 216.

Figure 2B:
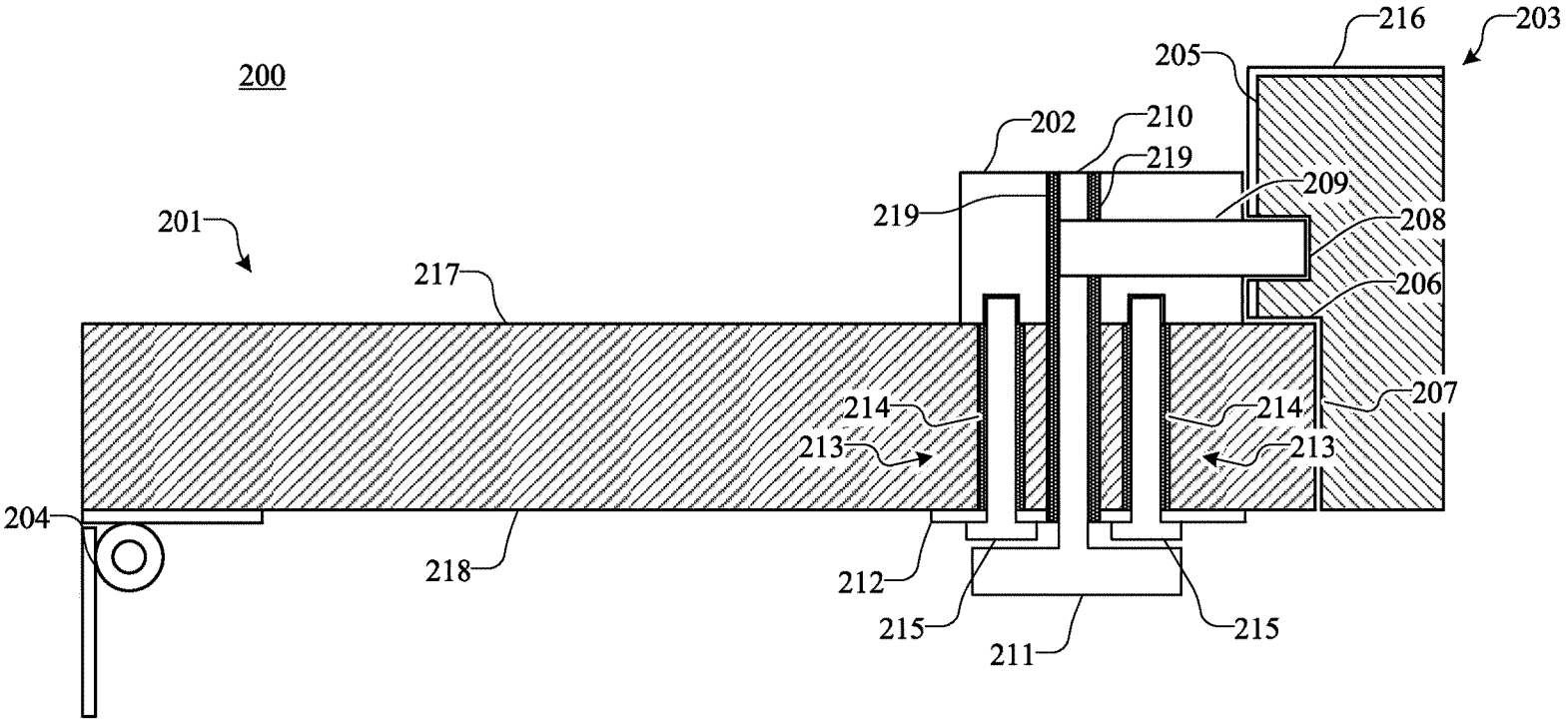
FIG. 2B is a cross sectional schematic view of the second example security door system of FIG. 2A, taken along line B-B of FIG. 2A.

FIG. 2B is a cross sectional schematic view of the second example security door system 200 of FIG. 2A, taken along line B-B of FIG. 2A (illustrating the door 201 as an in-swinging door as opposed to an out-swinging door because the door is configured to move from the shown closed position to the not shown open position by moving on the hinge 204 in the direction of the inward surface 218 of the door). By way of contrast with the first example security door system 100 of FIGS. 1A-1B, the aperture 208 for accepting the deadbolt 209 is defined in the soffit 205 instead of the rabbet 207. As a result, the deadbolt mechanism 202 may secure the door more effectively than the deadbolt mechanism 102 because of the larger dimension of the soffit over the rabbet. This may make popping the deadbolt free of the aperture more difficult than with the with the first example security door system 100 of FIGS. 1A-1B.

Further, the deadbolt mechanism 202 is mounted to the outside surface 117 of the door 201 and out of a plane of the door. Thus, the deadbolt mechanism is external to the door. As a result, the door may not include a cavity large enough to accommodate portions of the deadbolt mechanism internal to the door compared to the door 101 and deadbolt mechanism 102 of FIGS. 1A-1B. This may allow the door 201 to be stronger than the door 101 and may further make popping the deadbolt 209 free of the aperture 208 (and/or breaking down the door 201) more difficult than with the with the first example security door system 100 of FIGS. 1A-1B.

As illustrated, the deadbolt mechanism 202 may be mounted to the outside surface 217 of the door 201 by one or more attachment members 215 (of any number such as one, six, and so on) that extend from the opposing, inside surface 118 through attachment member apertures 213 in the door 201 (at thus through the door) out the outside surface into the deadbolt mechanism. The attachment members may be bolts.

As illustrated, in some implementations a mounting plate 212 (which may be made of metal such as stainless steel or brass and/or other rigid and/or strong material) may be positioned on the inside surface 218 of the door 201 and the attachment members 215 may extend through the mounting plate. This may further strengthen attachment of the deadbolt mechanism 202 to the door and make removal of the deadbolt mechanism by force more difficult. In various cases, a similar mounting plate may be positioned on the outside surface of the door through which the attachment members project before attaching to the deadbolt mechanism.

As illustrated, in some implementations shock absorbent material 214 may be variously positioned around the attachment members 215 in the attachment member apertures 213. This shock absorbent material may absorb at least some shock from a force applied to the deadbolt mechanism, making the deadbolt mechanism more resistant to removal or damage by force than that of the first example security door system 100 of FIGS. 1A-1B. Such force may be exerted as in a direction perpendicular to the surface of the door, such as where an unauthorized person attempts to utilize a sledge hammer and/or other tool to remove the deadbolt mechanism 202 from the door 201 by force.

In some cases, the shock absorbent material 214 may be formed of a material such as the synthetic polymer polybutadiene (and/or a mixture of polybutadiene, hydrated silica, zinc oxide, stearic acid, and other ingredients such that used to form the Super Ball® produced by Wham-O®), other polymer, and/or other shock absorbing material. In some cases, the shock absorbent material may partially surround the attachment members 215 in the attachment member apertures 213, fully surround the attachment members in the attachment member apertures, and/or be otherwise positioned with respect to attachment members the in the attachment member apertures.

In some implementations, the attachment members 215 may be threaded and may screw into threaded apertures in the deadbolt mechanism 202. In various implementations, the attachment members may be positioned within a strengthening member (not shown), such as a metal collar. Such a strengthening member may be correspondingly threaded such that the attachment members may screw internally into the strengthening member and the strengthening member may screw into threaded apertures in the deadbolt mechanism. In implementations where strengthening members are used, the shock absorbent material 214 may be positioned between the attachment member and the strengthening member and/or may partially and/or fully surround the strengthening member in the attachment member aperture 213.

In one or more implementations, the security door system may also include the reinforcement plate 216. The reinforcement plate (which may be formed of a metal such as stainless steel or brass and/or any other rigid or strong material) may surround the aperture 208 defined in the soffit 205. In some cases, the reinforcement plate may extend over multiple surfaces of the soffit, as shown. This reinforcement plate may further make popping the deadbolt 209 free of the aperture 208 and/or breaking the door jamb 203 more difficult than with the with the first example security door system 100 of FIGS. 1A-1B.

In various implementations, one or more tumbler bolts 219 may extend through the door 201 from the opposing, inside surface 218 of the door into a tumbler 210 of the deadbolt mechanism 202. The tumbler may be operable utilizing a key and/or similar mechanism to transition the deadbolt mechanism between locked and unlocked positions and the tumbler bolts may further secure the tumbler via direct mounting to the door, reducing the possibility that the deadbolt mechanism could be compromised by removing the tumbler.

In some implementations, a manipulation mechanism 211 (illustrated as a knob) may extend from the opposing, inside surface 218 of the door 201 through to the deadbolt mechanism 202. The manipulation mechanism may also be operable to transition the deadbolt mechanism between locked and unlocked positions. In this way, the deadbolt mechanism may be operable from the inside the door without positioning the deadbolt mechanism internal to the door like the first example security door system 100 of FIGS. 1A-1B.

Although the second example security door system 200 is illustrated and described above as including particular components arranged in a particular configuration, it is understood that this is an example. Various configurations of the same, similar, and/or different components are possible and contemplated without departing from the scope of the present disclosure.

For example, the door 201 is illustrated and described as moveably mounted on a hinge 204. However, in various other implementations moveable mounting mechanisms other than hinges may be utilized without departing from the scope of the present disclosure. In some implementations, the door may be moveable in a different fashion, such as in the case of a revolving door.

By way of another example, the deadbolt mechanism 202 is illustrated and described as utilizing a deadbolt 209. However, in various implementations other securing mechanisms may be used, such as a spring bolt or a sliding bar.

Figure 3:
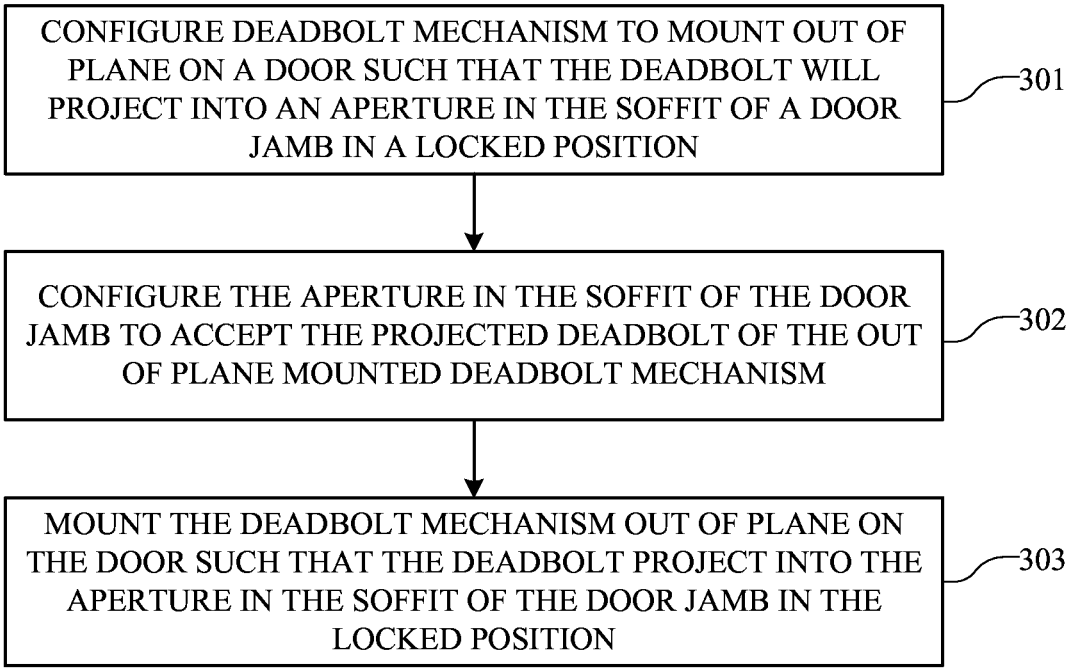
FIG. 3 is a method diagram illustrating an example method for assembling a security door. This method may assemble the second example security door system of FIG. 2A-2B.

FIG. 3 illustrates an example method 300 for assembling a security door. This method may assemble the second example security door system of FIG. 2A-2B.

The flow may begin at block 301 where a deadbolt mechanism is configured to mount out of plane on a surface of a door such that the deadbolt of the deadbolt mechanism will project in a locked position into an aperture in the soffit of a door jamb in which the door is mounted. Such configuration may include configuration of the deadbolt mechanism; configuration of how the deadbolt mechanism interacts with a mounting assembly such as one or more bolts, mounting plates and so on; and/or other such configuration possibilities.

The flow may then proceed to block 302 where the aperture in the soffit of the door jamb is configured to accept the projected deadbolt of the out of plane, surface mounted deadbolt mechanism. Such configuration may include boring, drilling, and/or otherwise forming the aperture in the soffit.

Next, the flow may proceed to block 303 where the deadbolt mechanism may be mounted out of plane on a surface of the door such that the deadbolt projects into the aperture in the soffit of the door jamb in the locked position. Mounting the deadbolt mechanism may include coupling the deadbolt mechanism to the door using a mounting assembly such as one or more bolts, mounting plates, and so on.

Although the example method 300 is illustrated and described as including particular operations performed in a particular order, it is understood that this is an example. In various implementations, various orders of the same, similar, and/or different operations may be performed without departing from the scope of the present disclosure.

For example, the method 300 is illustrated and described as including operations 301-303 that are performed in a linear, sequential order. However, in various implementations one or more of operations 301-303 may be performed without performing the other operations. Further, the operations may be performed in different orders and/or one or more of the operations may be performed substantially simultaneously and/or in parallel with one or more other of the operations. Various arrangements are contemplated and possible without departing from the scope of the present disclosure.

By way of another example, in some implementations the method 300 may include the additional operation of configuring the door such that the deadbolt mechanism may be mounted out of plane on a surface of the door such that the deadbolt projects into the aperture in the soffit of the door jamb in the locked position.

As described above and illustrated in the accompanying figures, the present disclosure details systems, apparatuses, and methods related to features of a security door. A security door system may include a door jamb, a door, and a deadbolt mechanism. The door jamb may include a soffit and an aperture defined in the soffit. The deadbolt mechanism may be mounted to a surface of the door and out of a plane of the door such that a deadbolt of the deadbolt mechanism is operable to project into the aperture in a locked position. In this way, the deadbolt mechanism may secure the door more effectively than a deadbolt mechanism mounted within the plane of the door and that projects a deadbolt into a rabbet of the door jamb.

In the present disclosure, the methods disclosed may utilize sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be utilize a computer program product, or software, that may include a non-transitory machine-readable medium having stored thereon instructions, which may be used to program a computer system (such as a computer controlled manufacturing system or other electronic devices) to perform a process utilizing techniques of the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

I claim:

1. A security door system, comprising:

a door that defines a plane, the door having:

a first surface parallel to the plane, the first surface facing a first direction in which the door is operable to swing when moving from an open position to a closed position;

a second surface parallel to the plane, the second surface opposing the first surface, the second surface facing a second direction in which the door is operable to swing when moving from the closed position to the open position;

a third surface perpendicular to the plane and positioned between the first and second surfaces;

a door jamb, the door jamb comprising:

a rabbet that is perpendicular to the plane defined by the door and that faces the third surface of the door when the door is in the closed position;

a soffit that projects from the rabbet, the soffit parallel to the plane defined by the door such that a surface of the soffit faces the first surface of the door, the soffit operable to stop the door moving in the first direction when the door moves from the open position to the closed position; and an aperture defined in the soffit; and a deadbolt mechanism mounted to the first surface of the door and out of the plane defined by the door such that a deadbolt of the deadbolt mechanism that is out of the plane defined by the door is operable to project into the aperture in a locked position.

2. The system of claim 1, wherein the deadbolt mechanism is mounted to the first surface of the door via an attachment member that extends through an attachment member aperture in the door to the first surface from the second surface of the door.

3. The system of claim 2, wherein the attachment member comprises at least one bolt.

4. The system of claim 3, further comprising a mounting plate positioned on the second surface of the door wherein the bolt extends to the deadbolt mechanism through the mounting plate, the second surface of the door, and the first surface of the door.

5. The system of claim 4, wherein the mounting plate comprises metal.

6. The system of claim 2, wherein a shock absorbent material is positioned at least partially around the attachment member in the attachment member aperture.

7. The system of claim 6, wherein the shock absorbent material comprises a polymer.

8. The system of claim 7, wherein the polymer comprises polybutadiene.

9. The system of claim 6, wherein the shock absorbent material surrounds the attachment member in the attachment member aperture.

10. The system of claim 6, wherein the shock absorbent material is configured to absorb at least some shock from a force applied to the deadbolt mechanism in a direction perpendicular to the first surface of the door.

11. The system of claim 2, wherein the attachment member is positioned within a strengthening member that extends through the attachment member aperture.

12. The system of claim 11, wherein the strengthening member comprises a metal collar.

13. The system of claim 1, further comprising a reinforcement plate that surrounds the aperture defined in the soffit and extends over multiple surfaces of the soffit.

14. The system of claim 1, further comprising at least one tumbler bolts that extend through the door from the second surface of the door into a tumbler of the deadbolt mechanism.

15. The system of claim 1, further comprising a manipulation mechanism that extends through the second surface of the door and the first surface of the door to the deadbolt mechanism.

16. The system of claim 15, wherein the manipulation mechanism is operable to transition the deadbolt mechanism from an unlocked position to the locked position.

17. The system of claim 1, wherein the deadbolt mechanism is external to the door.

18. The system of claim 1, wherein the soffit has a larger dimension than a rabbet of the door.

19. The system of claim 1, wherein the deadbolt mechanism is larger than a cavity defined in the door.

20. The system of claim 6, wherein the shock absorbent material comprises a mixture of polybutadiene, hydrated silica, zinc oxide, and stearic acid.

* * * * *